US006671348B2

(12) United States Patent
Ohkoda

(10) Patent No.: US 6,671,348 B2
(45) Date of Patent: Dec. 30, 2003

(54) X-RAY IMAGE DETECTING APPARATUS

(75) Inventor: Keiji Ohkoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 09/899,285

(22) Filed: Jul. 6, 2001

(65) Prior Publication Data

US 2002/0003863 A1 Jan. 10, 2002

(30) Foreign Application Priority Data

Jul. 7, 2000 (JP) ..... 2000-206418

(51) Int. Cl.[7] ..... G21K 1/00
(52) U.S. Cl. ..... 378/154; 378/70; 378/86
(58) Field of Search ..... 378/70, 86, 87, 378/88, 89, 140, 145, 149, 154

(56) References Cited

U.S. PATENT DOCUMENTS 5,801,385 A * 9/1998 Endo et al. ..... 250/370.11
5,956,382 A * 9/1999 Wiener-Avnear et al. .. 378/98.8
6,034,406 A * 3/2000 Kobayashi et al. ..... 257/435
6,118,851 A * 9/2000 Endo et al. ..... 378/98.8
6,429,578 B1 * 8/2002 Danielsson et al. .. 313/105 CM
2002/0117626 A1 * 8/2002 Danielsson ..... 250/370.01

* cited by examiner

*Primary Examiner*—Eric S. McCall
(74) *Attorney, Agent, or Firm*—Fitzpatrick, Cella, Harper & Scinto

(57) ABSTRACT

In an X-ray image detector including an X-ray grid unit for transmitting primary X-rays and removing scattered X-rays, a fluorescent substance for emitting fluorescence through excitation by X-rays, and photoelectric conversion elements for photoelectrically converting the fluorescence, these X-ray grid unit, fluorescent substance and photoelectric conversion elements are constituted together as a single unit. The plurality of photoelectric conversion elements are arranged two-dimensionally between each adjacent two of which there is a predetermined insensitive region. The X-ray grid is composed of a plurality of X-ray absorption members for removing the scattered X-rays, and the X-ray absorption members are disposed substantially only on the predetermined insensitive regions when viewed from a direction from which X-rays are incident. Further, the fluorescent substance is disposed substantially only in the regions between the X-ray absorption members that are adjacent to each other when viewed from a direction from which X-rays are incident.

17 Claims, 6 Drawing Sheets

X-RAY IMAGE DETECTING APPARATUS

BACKGROUND OF THE INVENTION

1. Field of the Invention

The present invention relates to an X-ray image detecting apparatus for detecting an X-ray image of a subject, such as a person to be examined for diagnosis or the like.

2. Description of the Related Art

Recently, X-ray image acquisition systems for taking X-ray images of subjects being examined for diagnosis using semiconductor sensors have been developed.

When compared with conventional X-ray radiographic systems employing ordinary silver halide photography, these X-ray image acquisition systems have such advantages in practical use that images can be recorded which have a very wide dynamic range corresponding to a very wide range in the amount of radiation, to which the sensor is exposed. That is, X-ray images can be obtained which are unlikely to be affected by variations in the amount of exposure of radiation; after X-rays with a very wide dynamic range are read with a detector including a photoelectric transducer and converted into an electric signal, the electric signal is processed so as to output X-ray images on recording materials such as a photosensitive material, and the like and on display units such as a CRT, and the like, as visible images. In this radiography, an X-ray grid, which removes scattered X-rays generated in subjects, are used in many cases in order to improve contrast in a radiographic image.

FIG. 1 is a sectional view of an X-ray grid and a detector used in a conventional radiographic apparatus. An X-ray image detector 1 is arranged such that a plurality of photoelectric conversion elements 3 are two-dimensionally disposed on an insulation substrate 2, and further, fluorescent substance 4 is laminated on the photoelectric conversion elements 3. In addition, a grid 5 is disposed above the X-ray image detector 1 with a predetermined space therebetween. The grid 5 is arranged such that foils 7, which are composed of lead or the like, having a high X-ray absorption ratio, and intermediate materials 8, which are composed of aluminum or the like, having a low X-ray absorption ratio, are held by a cover member 6. Using the grid 5 arranged as described above permits primary X-rays L1, which have passed through a subject without being scattered thereby, to pass through the grid 5 and to reach the fluorescent substance 4 of the X-ray image detector 1. When X-rays L1 are irradiated onto the fluorescent substance 4, the optical materials (light emitting materials) in the fluorescent substance 4 are excited and emit fluorescence L2 having a wavelength within the spectral sensitivity wavelength range of the photoelectric conversion elements 3. Further, X-rays which are incident on the grid 5 with a large angle with respect to the primary X-rays L1, such as a scattered X-ray component L3 generated by the subject, are absorbed by the foils 7.

During exposure of radiation, the grid 5 is moved in a direction B or C by a drive unit (not shown). With this operation, an excellent image can be obtained by the X-ray image detector 1 which has no image component of stripes of the grid 5 as well as no moires or aliasing caused by a difference between the pitch of the foils 7 and the pitch of the pixels of the X-ray image detector 1.

Radiography is required to satisfy contradictory conditions (1) that an excellent image with a high contrast is to be obtained while (2) reducing the dosage of the subjects as much as possible by reducing the amount of X-rays with which they are irradiated. However, the grid 5 shown in FIG. 1 may act as a factor for deteriorating an image by reducing the intensity of X-rays on the X-ray image detector 1.

One reason for this reducing of the intensity of X-rays is that the X-rays L1, which reach the X-ray image detector 1, must pass through the intermediate materials 8. While the intermediate materials 8 are composed of aluminum or the like having a high X-ray transmission ratio as described above, that transmittance is not 100% as a matter of fact. When, for example, the thickness $\Delta 1$ of the foils 7 is set to 43 $\mu$m at a time a grid density is 40 lines/cm and a grid ratio is 10:1, the intermediate materials 8 have a thickness $\Delta 2$ of 207 $\mu$m (=1 cm/40−$\Delta 1$) and a height $\Delta 3$ of 2070 $\mu$m (=$\Delta 2 \times 10$).

When the intermediate materials 8 are composed of aluminum, the aluminum in the above case has a thickness of about 2 mm, and the primary X-rays L1 have a transmittance of about 70%. Accordingly, about 30% of the intensity of the X-rays will be lost. Further, when viewed from the direction from which the X-rays are incident, 17% (=$\Delta 1/(\Delta 2+\Delta 1)$) of the grid 5 is composed of lead through which X-rays do not pass. Accordingly, the total X-ray transmittance of the grid 5 is about 60% ($0.7\times(1-0.17)$) when the loss of the intermediate materials 8 is also taken into consideration, which means that the reduction of the intensity of X-rays caused by the grid 5 is large and cannot be ignored.

Further, the fluorescence L2 generated in the fluorescent substance 4 by the primary X-rays which have passed through the grid 5, radiates in various directions because the fluorescent substance 4 is formed in a continuous flat shape so as to entirely cover the photoelectric conversion elements 3. Accordingly, this fluorescence L2 reaches not only a photoelectric conversion element 3*a* located just below a position where it emits but also other photoelectric conversion elements, for example, 3*b*, and the like adjacent to the photoelectric conversion element 3*a*.

Therefore, as described below, the grid 5 reduces the intensity of X-rays, while it does remove the incident scattered X-ray component L3. Further, the continuous flat-shaped fluorescent substance 4 may deteriorate the MTF (modulation transfer function) of the X-ray image detector because the fluorescence L2 generated in the fluorescent substance 4 reaches a plurality of adjacent photoelectric conversion elements. Furthermore, when the intensity of the emitting fluorescence L2 is increased by increasing the thickness of the fluorescent substance 4 to improve the intensity of signals outputted from the photoelectric conversion elements 3, the above tendency becomes stronger, and improvement of the sensitivity of X-ray image detectors may be impeded.

SUMMARY OF THE INVENTION

Accordingly, it is an object of the present invention, which was made based on the above recognition of the problem, to provide an excellent X-ray image detecting apparatus capable of obtaining a good image having a high contrast while reducing the dosage received by a subject.

Further objects, features and advantages of the present invention will become apparent from the following description of the preferred embodiments with reference to the attached drawings.

DESCRIPTION OF THE PREFERRED EMBODIMENTS

The present invention will be described below in detail with reference to the embodiments shown in to FIGS. 2 to 7.

Figure 2:
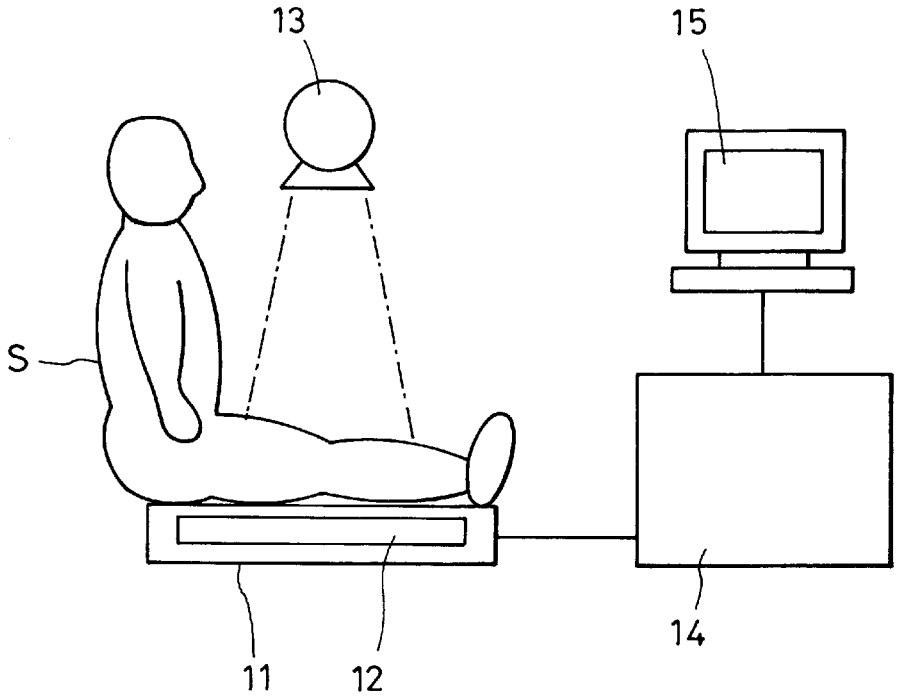
FIG. 2 is a schematic view of a radiographic system.

FIG. 2 shows an overall schematic view of a radiographic system.

A radiographic apparatus 11 includes an X-ray image detecting apparatus 12 having a detecting surface on which a plurality of photoelectric conversion elements are disposed two-dimensionally. As will be described below, the X-ray image detecting apparatus 12 includes an X-ray image detector in which X-ray grids, fluorescent substances (which serve, as is well known, to convert incident X-rays to light of a predetermined wave-length; such substances, and any and all arrangements that can transform X-rays to light, are herein referred to sometimes as an X-ray converter or conversion member) and the photoelectric conversion elements are constituted together as a unit, i.e., integrated in one united body. X-rays irradiated from an X-ray generator 13 having an X-ray tube are applied to a person S as a subject being examined for diagnosis, and X-rays that have passed through the person S are detected by the X-ray image detecting apparatus 12. Thus-obtained image data is digitally processed by an image processing apparatus 14 including a computer, and the image data that has been processed is stored in the computer as well as displayed on a display unit 15 as an X-ray image of the person being examined.

Figure 3:
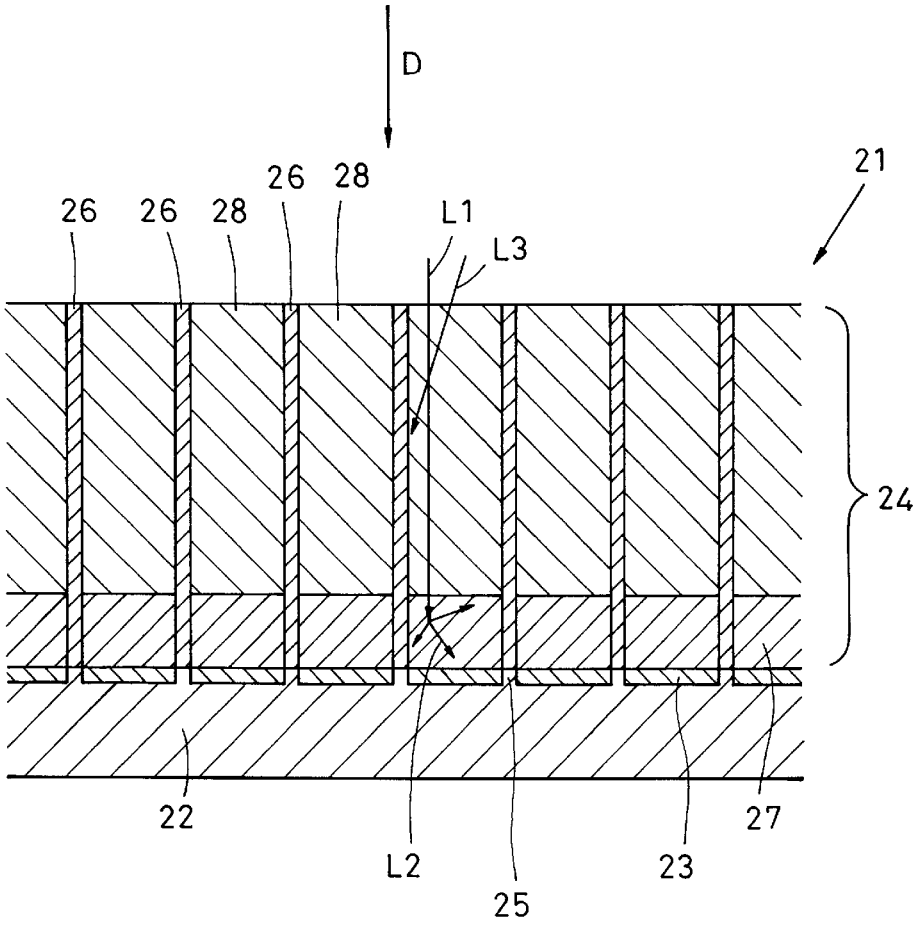
FIG. 3 is a sectional view of a first embodiment of an X-ray image detecting apparatus of the present invention.

FIG. 3 is shows a sectional view of an X-ray image detector 21 built in the X-ray image detecting apparatus 12. The X-ray image detector 21 is arranged such that a plurality of photoelectric conversion elements 23 are disposed two-dimensionally on the plane of an insulation substrate 22, the plane extending in the direction perpendicular to the sheet surface of FIG. 3, and further, a grid unit 24 is disposed on the photoelectric conversion elements 23, that is, at a side toward incident X-rays. In addition, the spaces between the photoelectric conversion elements 23 are arranged as insensitive regions 25, which have no sensitivity to fluorescence.

A glass sheet is used as the insulation substrate 22 because it does not chemically act on semiconductor devices that form the photoelectric conversion elements 23 and the like, endures the high temperatures involved in semiconductor manufacturing processes, is stable dimensionally, and is able to have a high degree of flatness.

The grid unit 24 has grids which are formed of foils 26 composed of lead having a large x-ray absorption ratio, and the spaces between the respective grids are filled with fluorescent substances 27 and intermediate substances 28, sequentially in this order, in a direction opposite to the direction from which X-rays are incident. A photoelectric conversion element 23 is disposed just under a corresponding fluorescent substance 27, which is located between each pair of grids, and as well, each photoelectric conversion elements 23 is disposed so as to avoid a portion shaded by a foil 26, and the shaded portion is arranged as an insensitive region 25. The thickness of each foil 26 is in approximate agreement with the width of the insensitive region 25.

The fluorescent substances 27 located between the respective grids are spatially separated from each other by the foils 26 in order to prevent crosstalk in which fluorescence L2 generated by the fluorescent substances 27 on the respective photoelectric conversion elements 23 is incident on adjacent photoelectric conversion elements 23. The intermediate substances 28 are disposed to reinforce the foils 26 having low rigidity and composed of aluminum, paper, wood, synthetic resin or carbon-fiber-reinforced resin, or the like, having a small X-ray absorption ratio. The fluorescent substances 27 are partitioned by the foils 26, and the intermediate substances 28 are laminated or layered on the fluorescent substances 27. While the foils 26 are mainly composed of lead, when the surfaces thereof are arranged as reflecting surfaces for reflecting fluorescence, fluorescence generated by the fluorescent substances 27 is reflected on the foils 26, which increases the amount of fluorescence incident on corresponding photoelectric conversion elements 23, thereby improving the S/N of a detection signal.

Figure 4:
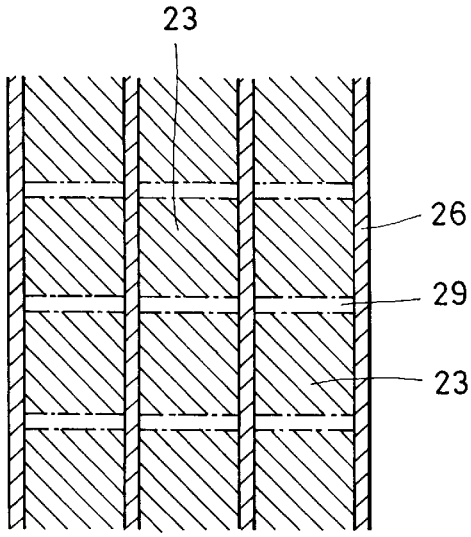
FIG. 4 is a plan view of the first embodiment the X-ray image detecting apparatus of the present invention.

FIG. 4 is a sectional view of the X-ray image detector 21 shown in FIG. 3 when it is viewed from a direction D (an x-ray incident direction). Each photoelectric conversion element 23 is formed in an approximate square shape, and each grid formed by the foils 26 have a slit or strip shape. The grids are filled with intermediate substances 28 having a slit shape formed in accordance with the shape of the grids. The photoelectric conversion elements 23 formed just under the intermediate substances 28, each having the approximately square shape, are distributed two-dimensionally. Insensitive regions 29 are formed between the respective photoelectric conversion elements 23. Note that it is not always necessary that the girds formed by an X-ray grid be formed in a shape of stripes, and they may instead be formed in a matrix shape. In this case, the respective grids may be formed in a quadrangular shape (a square shape or a rectangular shape) or may be formed in a polygonal shape other than a quadrangular shape, for example, in a hexagonal honeycomb shape.

Since primary X-rays L1 are incident on the grid unit 24 in approximately parallel to the foils 26, they pass through the intermediate substances 28 and reach the fluorescent substances 27 and make it emit the fluorescence L2, to which the photoelectric conversion elements 23 have sensitivity, in the fluorescent substances 27. While the fluorescence L2 is emitted at various angles, it does not reach other adjacent photoelectric conversion elements 23 because it does not pass through the foils 26. In contrast, since scattered X-rays L3 are incident on the grid unit 24 obliquely to (i.e., not parallel to) the foils 26 but at a certain angle with respect to it, most of the scattered X-rays L3 are absorbed by the foils 26, and the ratio of them that reach the fluorescent substances 27 or the photoelectric conversion elements 23 is small.

Since the foils 26 exist only on the insensitive regions 25 between the photoelectric conversion elements 23, they do not block the X-rays to be intrinsically detected that are not scattered by the subject and incident toward the fluorescent substances 27 on the photoelectric conversion elements 23. Therefore, the reduction of the transmittance of X-rays, which is determined by the ratio of the thicknesses of the intermediate substances 28 and the foils 26 (opening ratio), does not occur in this arrangement, while this reduction is a problem in the conventional art employing the moving grid.

Figure 1:
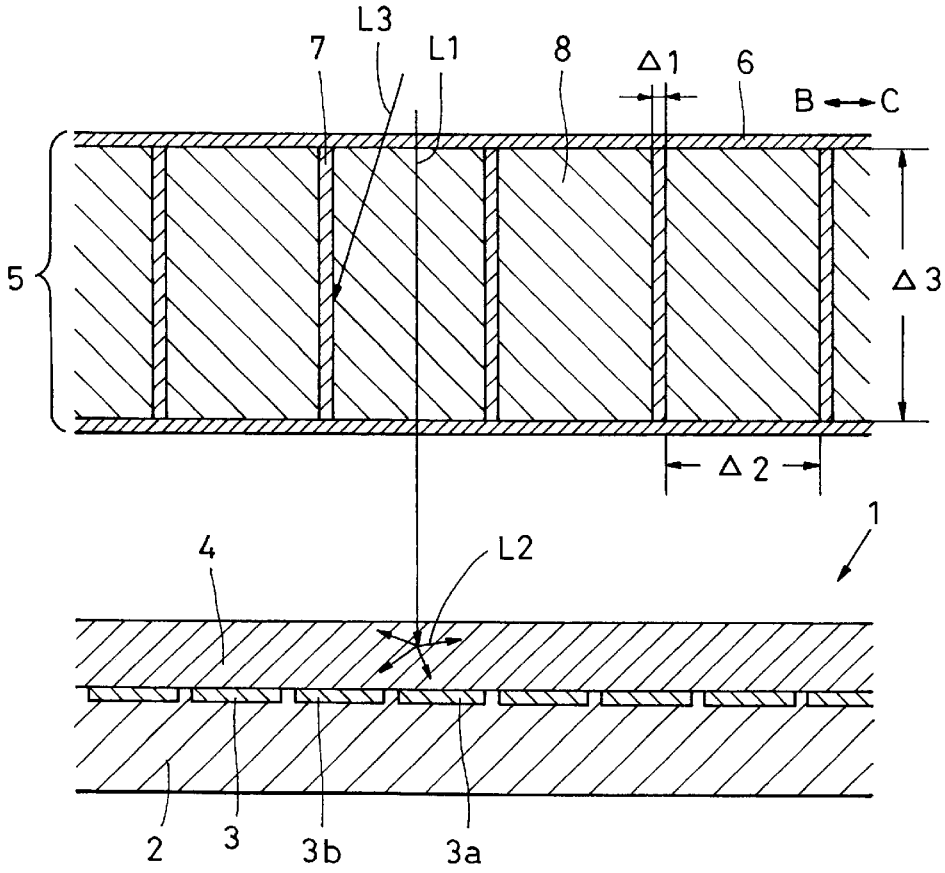
FIG. 1 PRIOR ART
FIG. 1 is a sectional view of an X-ray grid and a detector of a conventional X-ray image detecting apparatus.

When, for example, it is assumed in the conventional example shown in FIG. 1 that the foils 7 have a thickness of 43 $\mu$m and the intermediate substances 8 have a thickness of 207 $\mu$m, about 17% of the arrangement (43/(43+207)) blocks the transmission of X-rays, and thus their opening ratio is 83%. In contrast, in this embodiment, an opening ratio of 100% can be secured while having the grid unit 24. This means that sensitivity can be improved about 20% while using the same photoelectric conversion elements 23, which permits a reduction in dosage received by persons being examined.

Further, in the X-ray image detector of this embodiment, the foils 26 exhibit multiplied actions not only removing the scattered X-rays L3 incident on the foils 26 but also solving the problem which is caused by the diverged component or the scattered component of the fluorescence L2 by spatially separating the fluorescent substances 27. That is, the foils 26 reduce the above-mentioned crosstalk between adjacent photoelectric conversion elements. By this arrangement, the MTF can be improved, and an excellent X-ray image can be taken.

Further, while the fluorescent substances 27 are formed continuously in the direction perpendicular to the sheet surface (the depth direction) of FIG. 3 in the above embodiment, the fluorescent substances 27 located on the insensitive regions 29 may be removed in correspondence to the approximately square shape of the photoelectric conversion elements 23. In this case, the MTF also will be improved in this direction (the depth direction). The grid unit 24 arranged as described above, of which a grid ratio (i.e., height of the foil of the grid as shown in the Figures divided by spacing between adjacent vertical foils of the grid) is preferably set to at least 3:1, can achieve a large effect for removing the scattered X-rays L3.

Figure 5:
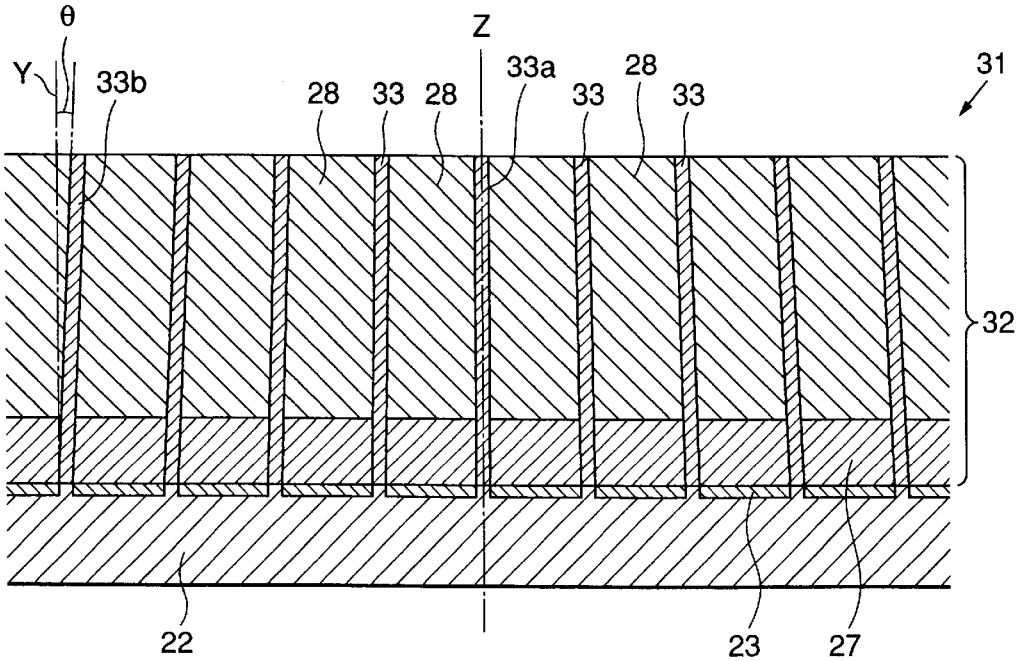
FIG. 5 is a sectional view of a second embodiment of the X-ray image detecting apparatus of the present invention.

FIG. 5 shows a sectional view of a second embodiment of the X-ray image detecting apparatus of the present invention, wherein the same components as used in the first embodiment are denoted by the same reference numerals. The second embodiment is different from the first embodiment as described below. That is, in the first embodiment, the grid unit 24 is arranged as a parallel grid all foils of which are disposed parallel to each other, whereas in the second embodiment, a grid unit 32 of an X-ray image detector 31 is arranged as a converging grid foils of which are tilted symmetrically with respect to a center line Z acting as a symmetrical axis.

Specifically, foils 33*a* in the vicinity of the center line Z are disposed perpendicular to the detecting surfaces of photoelectric conversion elements 23, and foils 33*b* in the periphery of the grid unit 32 are tilted with respect to the direction of the center line Z. The angle θ of foils 33 with respect to the normal Y of the detecting surfaces of the photoelectric conversion elements 23 is 0 in the vicinity of the center line Z, and increases with distance of the foil 33 from the center line Z. Note that the extending lines of all the foils 33 (i.e., the planes of all the foils) intersect with each other at one point (focal point) on the center line Z. Ordinarily, a radiographic system is arranged such that this focal point is in approximate agreement with the emitting point of an X-ray source from which X-rays emit.

When an X-ray image is taken using the converging grid together with an X-ray tube having an emitting point located at the focal point of the converging grid, a still more excellent image can be obtained which does not have any vignetting caused by the foils 33 even in the periphery of the grid unit 32, that is, in which the intensity of X-rays is not reduced even in the periphery thereof.

Figure 6:
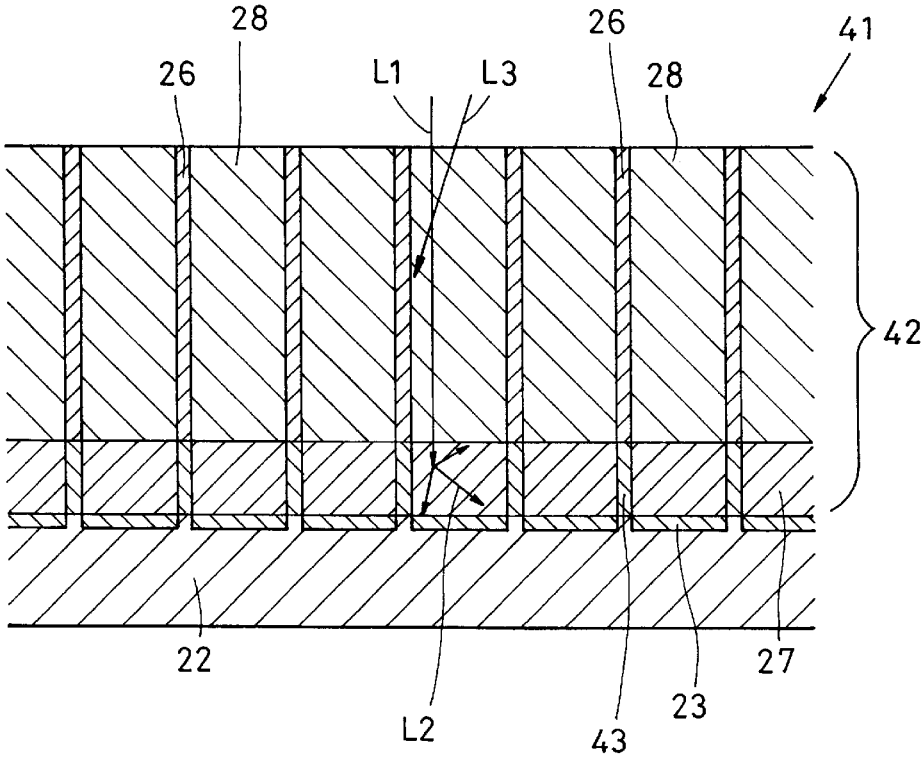
FIG. 6 is a sectional view of a third embodiment of the X-ray image detecting apparatus of the present invention.

FIG. 6 is a sectional view of a third embodiment of the X-ray image detecting apparatus 41 of the present invention. In the previous embodiments, the flourescent substances in the grid unit of the X-ray image detector are partitioned by the grid foils. In the third embodiment, however, partitions 43, which are different from grid foils 26, are disposed only in the portions where flourescent substances 27 are partitioned so that adjacent flourescent substances can be spatially separated from each other by the partitions 43. The partitions 43 have a property that they do not transmit the fluorescence L2, since they block it by reflecting or absorbing it, while they may absorb the X-rays in a small amount.

In a grid unit 42 arranged as described above, the foils 26 can remove scattered X-rays incident downward, and as well, the partitions 43 can prevent the diverged or scattered component of the fluorescence L2 generated in the fluorescent substances from invading into adjacent regions, whereby occurrence of crosstalk can be prevented. Further, the portion of the grid unit 42 excluding the fluorescent substances 27 and the partitions 43 has a structure in which only the foils 26 and intermediate substances 28 are alternately disposed, and thus the portion of the grid unit 42 can be simply made by a conventional manufacturing method.

Note that, as a modification, a similar function also can be obtained in an arrangement in which the portions of the partitions 43 are composed of simple cavities, the fluorescent substances 27 are spatially separated for each grid, and a reflecting layer or a shading layer is formed on a side of each fluorescent substance 27.

Figure 7:
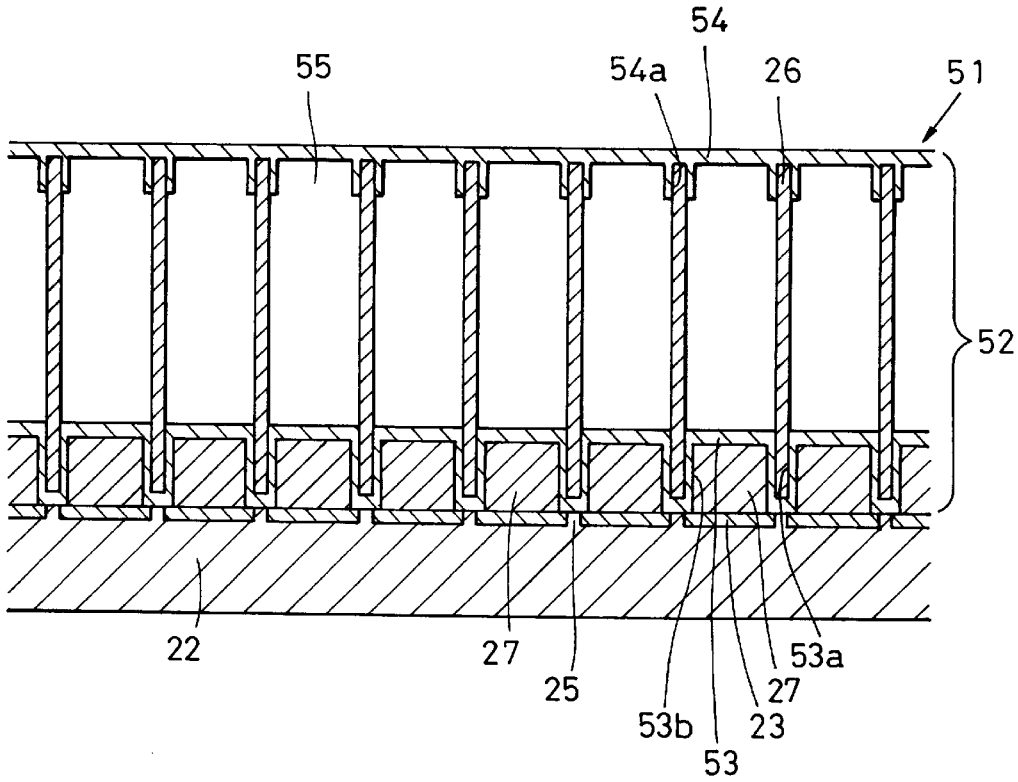
FIG. 7 is a sectional view of a fourth embodiment of the X-ray image detecting apparatus of the present invention.

FIG. 7 shows a sectional view of a fourth embodiment of the X-ray image detecting apparatus of the present invention. Each of the foils 26 of a grid unit 52 of an X-ray image detector 51 is supported with its lower end inserted into one of a plurality of grooves 53*a* formed on the upper surface of a resin plate 53. Further, a plurality of recesses 53*b* are formed on the lower surface of the resin plate 53 at the same pitch as the foils 26 and are filled with fluorescent substances 27. That is, the fourth embodiment has a structure in which the fluorescent substances 27 are spatially separated in correspondence to the spaces between the respective foils. Note that the resin plate 53 has a property that it blocks fluorescence emitted from the fluorescent substances 27 by reflection, absorption or the like. Otherwise, the resin plate 53*b* is provided with this property. In contrast, the upper ends of the foils 26 are held by a resin plate 54 having grooves 54*a* formed thereon at the same pitch as the grooves 53*a*. The grid unit 52 has sufficient rigidity because the foils 26 are held by the grooves 53*a* and 54*a*, which permits the spaces between the foils 26 to be arranged as cavities 55 without being filled with intermediate substances.

This arrangement can avoid a loss caused when X-rays pass through the intermediate substances, in addition to being able to remove any scattered X-rays and crosstalk that is caused by fluorescence. For example, when the intermediate substances 28 in the first embodiment are composed of aluminum having a thickness of 2 mm, they have a transmittance for the X-rays L1 of about 70%. That is, sensitivity can be improved about 40% (≈1/0.7−1) by the removal of the intermediate substances. As a result, compatibility can be established between a further reduction in the dosage received by the subject and improvement of image quality.

Note that rigidity may be further improved by providing cover portions or bonded layers on the surfaces of the grid foils, in the spaces between the grid foils and the fluorescent substances, or in the spaces between the fluorescent substances and the photoelectric conversion elements.

The employment of the grid unit 52 arranged as described above can remove a large amount of a scattered X-ray component, and can reduce crosstalk between the respective photoelectric conversion elements due to converged fluorescence, whereby image contrast can be improved, and as well, a decrease in the intensity of X-rays can be reduced when they transit the grid unit. That is, the reduction of the dosage received by subjects and the improvement of image quality, which are ordinarily inconsistent with each other, can be satisfied at the same time.

The X-ray image detecting apparatus using the X-ray image detectors of all of the embodiments described above has such advantages as high reliability, less expensive cost and easy maintenance because it can obtain an excellent image without the need for a mechanism for moving an X-ray grid.

Further, it is needless to say that the above-mentioned third and fourth embodiments may employ a converging grid, as in the second embodiment.

As described above, according to the X-ray image detecting apparatus of the present invention, an excellent image having high contrast can be obtained while reducing the dosage received by the subject.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An X-ray image detecting apparatus comprising:

an X-ray grid arranged to remove X-rays scattered by a subject;

a conversion member for converting X-rays passed by said X-ray grid into light having a predetermined wavelength; and a plurality of photoelectric conversion elements arranged to receive light from said conversion member, wherein said plurality of photoelectric conversion elements are arranged two-dimensionally spaced apart from each other and have predetermined insensitive regions disposed between said photoelectric conversion elements, said X-ray grid comprises a plurality of X-ray absorption members for removing scattered X-rays, each of said X-ray absorption members being arranged substantially only on said insensitive regions when viewed from a direction from which x-rays are incident, and said conversion member is arranged only in regions between said X-ray absorption members that are substantially adjacent to each other when viewed from the direction from which X-rays are incident.

2. The apparatus according to claim 1, wherein said conversion member is partitioned by said X-ray absorption members.

3. The apparatus according to claim 1, wherein said conversion member is partitioned by predetermined members which are different from said X-ray absorption members and located adjacent to each other.

4. The apparatus according to claim 3, wherein said predetermined members have a property of substantially not transmitting the light from said conversion member.

5. The apparatus according to claim 1, wherein said conversion member is partitioned by cavities, and wherein the surface of said conversion member facing said cavities has a property of substantially not transmitting the light from said X-ray conversion member.

6. The apparatus according to any one of claims 1 or 2 to 5, wherein when viewed from a direction from which X-rays are incident, said X-ray absorption members are arranged in a stripe pattern and said conversion member is divided into parts, in a direction along said X-ray absorption members, in correspondence to respective ones of said photoelectric conversion elements.

7. The apparatus according to any one of claims 1 or 2 to 5, wherein said X-ray grid is a converging grid having a predetermined focal point.

8. The apparatus according to any one of claims 1 or 2 to 5, wherein said X-ray grid comprises intermediate substances disposed between said X-ray absorption members.

9. The apparatus according to claim 1, further comprising:

a first member, for supporting one end of each of said X-ray absorption members on one surface of said first member as well as holding said conversion member on another surface of said first member; and a second member, for holding another end of each of said X-ray absorption members.

10. The apparatus according to claim 9, wherein said first member separates and holds said conversion member so that said conversion member is disposed substantially only in regions between said X-ray absorption members that are adjacent to each other when viewed from a direction from which X-rays are incident.

11. The apparatus according to claim 10, wherein said first member has a property of substantially not transmitting the light from said conversion member.

12. The apparatus according to claim 1, wherein said photoelectric conversion elements are arranged on an insulation substrate.

13. The apparatus according to claim 1, wherein said X-ray absorption members are arranged in a matrix or in a stripe pattern when viewed from a direction from which X-rays are incident.

14. The apparatus according to claim 1, wherein said X-ray absorption members have a property of reflecting the light from said conversion member.

15. The apparatus according to claim 1, wherein said X-ray grid has a grid ratio of at least 3:1.

16. An X-ray image acquisition apparatus comprising:

an X-ray generator; and an X-ray image detector, wherein said X-ray image detector comprises:

an X-ray grid arranged to remove X-rays scattered by a subject;

a conversion member for converting X-rays passed by said X-ray grid into light having a predetermined wavelength; and a plurality of photoelectric conversion elements arranged to receive light produced by said conversion member, wherein said plurality of photoelectric conversion elements are arranged two-dimensionally with a predetermined insensitive region between each adjacent two of said photoelectric conversion elements, said X-ray grid comprising a plurality of X-ray absorption members for removing scattered X-rays, said X-ray absorption members are disposed substantially only on said insensitive regions when viewed from a direction from which X-rays are incident, and said conversion member is arranged only in regions between said X-ray absorption members that are substantially adjacent to each other when viewed from a direction from which X-rays are incident.

17. An X-ray image acquisition apparatus comprising:

an X-ray image detector; and an image processor that receives and processes image data obtained using said X-ray image detector, wherein said X-ray image detector comprises:

an X-ray grid;

a conversion member for converting X-rays passed by said X-ray grid into light having a predetermined wavelength; and a plurality of photoelectric conversion elements arranged to receive light produced by said conversion member, wherein said plurality of photoelectric conversion elements are arranged two-dimensionally with a predetermined insensitive region between each adjacent two of said photoelectric conversion elements, said X-ray grid comprises a plurality of X-ray absorption members for removing scattered X-rays, said X-ray absorption members are disposed substantially only on said insensitive regions when viewed from a direction from which X-rays are incident, and said X-ray conversion member is arranged only in regions between said X-ray absorption members that are substantially adjacent to each other when viewed from a direction from which X-rays are incident.

* * * * *

UNITED STATES PATENT AND TRADEMARK OFFICE

CERTIFICATE OF CORRECTION

PATENT NO. : 6,671,348 B2
DATED : December 30, 2003
INVENTOR(S) : Ohkoda

It is certified that error appears in the above-identified patent and that said Letters Patent is hereby corrected as shown below:

Column 1,
Line 60, “moires” should read -- moirés --.

Column 3,
Line 43, “is” should be deleted; and
Line 61, “x-ray” should read -- X-ray --.

Column 4,
Line 27, “x-ray” should read -- X-ray --;
Line 37, “girds” should read -- grids --; and
Line 46, “in” should be deleted.

Column 5,
Line 46, “a” should be deleted.

Column 7,
Line 53, “x-rays” should read -- X-rays --.

Column 8,
Lines 6, 13 and 16, “or 2” should be deleted.

Signed and Sealed this

Twelfth Day of October, 2004

JON W. DUDAS
*Director of the United States Patent and Trademark Office*